United States Patent [19]

Albersdörfer et al.

[11] Patent Number: 4,846,678

[45] Date of Patent: Jul. 11, 1989

[54] MEANS AND METHOD FOR HEAT TREATMENT OF GREEN BODIES

[75] Inventors: Gernot Albersdörfer, Lauf; Reiner Swoboda, Nürnberg, both of Fed. Rep. of Germany

[73] Assignee: Riedhammer GmbH und Co. KG, Nurnberg, Fed. Rep. of Germany

[21] Appl. No.: 90,256

[22] Filed: Jul. 6, 1987

[30] Foreign Application Priority Data

Nov. 29, 1985 [DE] Fed. Rep. of Germany ..... 3542352
Nov. 13, 1986 [WO] World Int. Prop. O. ..... PCT/DE86/00462

[51] Int. Cl.[4] ..... F27B 9/26
[52] U.S. Cl. ..... 432/137; 432/144; 432/145
[58] Field of Search ..... 432/128, 136, 137, 144, 432/145, 155, 192

[56] References Cited

U.S. PATENT DOCUMENTS

| | | | |
|---|---|---|---|
| 1,652,570 | 12/1927 | Hanley, Jr. | 432/137 |
| 1,653,174 | 12/1927 | Hanley, Jr. | 432/137 |
| 1,838,672 | 12/1931 | Hanley, Jr. | 432/137 |
| 3,172,647 | 3/1965 | Remmey | 432/145 |
| 4,249,895 | 2/1981 | Mantegani | 432/145 |
| 4,627,814 | 12/1986 | Hattori et al. | 432/144 |
| 4,674,975 | 6/1987 | Corato et al. | 432/145 |

FOREIGN PATENT DOCUMENTS 140740 10/1920 United Kingdom .

*Primary Examiner*—Henry C. Yuen
*Attorney, Agent, or Firm*—John F. A. Earley; John F. A. Earley, III

[57] ABSTRACT

The invention relates to means for heat treating green bodies comprising two mutually parallel kiln channels operated in opposite directions each having at least one heating section, firing section, and cooling section, where an offtake means leads from one kiln channel to a combustion chamber, from which a supply means runs into the one or other kiln channel.

21 Claims, 2 Drawing Sheets

MEANS AND METHOD FOR HEAT TREATMENT OF GREEN BODIES

Figure 1:
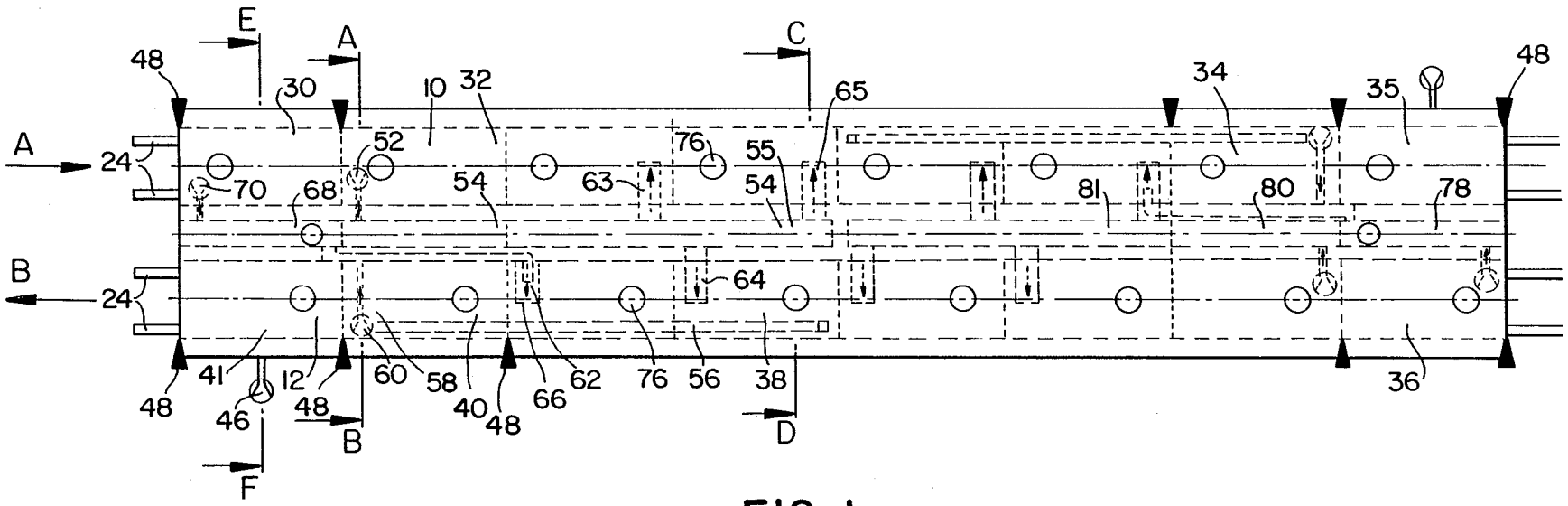

The invention relates to means for heat treatment of green bodies (shaped articles) with two mutually parallel furnace channels through which the products to be fired are guided in opposite directions, with at least one heating section, at least one firing section, and at least one cooling section along each channel, and further relates to a corresponding method for heat treatment.

Means as described above is known from DE-OS No. 30 42 708. With the tunnel kiln disclosed therein, the heat withdrawn from one section of one kiln channel may be used in another section of the other kiln channel, and for this purpose ventilating means are provided for a gas transport in counterflow to the products transport.

A similar arrangement is also disclosed in De-OS No. 30 23 228 where the products moved in two mutually opposite directions through the kiln chamber are subjected to a circulating transverse flow of the kiln gases which flows through the products, in order to manage a heat exchange between the products flows.

The prior art kilns are used for firing porcelain (DE-OS NO. 30 42 708) and blast furnace coke (DE-OS NO. 30 23 228), respectively.

The prior art devices are not suitable for heat treatment of materials containing a larger amount of pyrolysable substances, in particular not suitable for green bodies, because the pyrolysable substances which are emitted during the heat treatment are only guided in a cycle, thus increasing the pollution burden on the kiln atmosphere.

Substances are known which emit, to some extent, considerable amounts of such pyrolysable substances during the firing process. For example carbon electrodes which have been impregnated under vacuum with tar or pitch and/or have been mixed with ground coke, graphite, or carbon black, emit considerable amounts of pyrolysable substances during the firing process (for example tar and/or pitch vapors) which put a considerable burden on the kiln atmosphere.

The pyrolysis products are often not in thermal equilibrium, such that for example on the hot walls of the kiln secondary crack products are formed like retort carbon and, above all, carbon black, which lead to an increasing reduction of the cross section.

It is known to avoid the deposit and precipitation of carbonaceous substances by burning the volatile pyrolysis products. The applicant has already suggested, for a pyrolytic process in a chamber kiln, to admit oxygen to the circulating flue gas such that below a chamber temperature of 600° C. the fuel is burned with admitting a stoichiometric amount of air and that, at chamber temperatures above 600° C., an additional supply of air is fed to the chamber by special nozzles.

A kiln designed correspondingly and the associated method, respectively, have considerably decreased the explosion hazard, the method as such is not easy to handle, however, and therefore new measures are sought for optimizing the pyrolytic process. Furthermore, it is an object to achieve a complete firing with utmost energy effectiveness and a high standard of safety, and to achieve a continuous heat treatment in a continuously operating furnace.

The invention is based on the finding that an improvement of the firing process may be achieved by drawing off the flue gases with the pyrolysable substances from the kiln channel of a continuously operating kiln, by burning the flue gases in a separate chamber without continuous burner support and with energy gain, and by introducing the purified, burned flue gases subsequently into the kiln channel at a different location.

The invention is further based on the finding that an adhesion or deposit, for example on the walls of the kiln, may be avoided and that the heat generated during combustion of the flue gases may be optimally used, by guiding the combustible gases emitted by the firing products and picked up by the flue gas to the combustion on the shortest way and to supply them subsequently to the channel of the kiln as usable heat on a similar short way. It has been found that the entire kiln may be heated without burners by mere "self-burning" of the flue gas under corresponding admission of oxygen. With firing products like carbon the flue gas has a considerable amount of combustible components (binders) which may not only be rendered harmless by combustion but which is also sufficient to produce the energy required for heat treatment of the products.

For achieving these objects the invention suggests a tunnel kiln with the features of claim 1.

DE-OS No. 20 01 148 discloses a tunnel kiln where gases are suctioned from the kiln and are burned in a combustion chamber arranged outside the channel of the kiln. This "external" combustion is performed, however, compulsory by fuel-supplied burners and is intended only for avoiding a direct contact of the burner flame with the delicate firing products (earthenware).

According to the invention a combustion of the pyrolysable substances may be achieved in the simplest manner outside the channel of the kiln, and, on the other hand, the heat thus produced may be introduced as available heat on a similar short way to the channel of the kiln where the gases have been taken from before, and/or to the kiln channel next to it. Thus control of the firing process in the single channels of the kiln is considerably facilitated by excluding any explosion hazard, in addition to the considerable savings of energy. Only for starting the kiln an auxiliary burner for ignition is required. Subsequently the flue gas which is supplied with oxygen in a controlled manner burns by itself. The external energy consumption is thus virtually equal to zero. By means of a corresponding control/automatic control of the supply means (oxygen, flue gas) an optimal combustion and supply of available heat to certain sections of the kiln may be achieved.

Guiding the flue gases is facilitated by providing at least one fan and/or at least one sucking fan in the region of the offtake means and/or the supply means. Possibly for example the injector action of the firing chamber might be sufficient for producing a gas flow.

According to a preferred embodiment of the invention it is suggested to form the chamber for combustion of the flue gases as an enlarged channel. The offtake means and/or the supply means may be connected from the ceiling section of a kiln channel to the channel, as suggested by another embodiment of the invention.

As mentioned above the objects of the invention are achieved in a particular advantageous manner with regards to all aspects of the invention, if the supply means is (are) led in a small distance to the offtake means into the channel of the kiln, in order to keep the distances as short as possible.

It is advantageous to introduce the fresh air immediately adjacent to that location of the chamber of the kiln where the flue gases are introduced, too. Thus the selfignition performs best.

In order to further improve the combustion it is suggested, according to another embodiment of the invention, to guide the fresh air supply line at least partially inside the walls or the ceiling of the kiln according to the invention, because these are inevitably very hot, in particular in the region of the firing section, thus rendering possible a preheating of the fresh air supplied from the outside. Fans may be provided here, too, for supporting the air flow.

Preferredly, the offtake and supply means are arranged within the respective firing sections of the two channels of the kiln, and here preferredly at least at the start, because in these regions particular large amounts of the combustible substances mentioned above are emitted and may be utilized.

A further optimization may be achieved by arranging the firing chamber in parallel relationship in between the two channels of the kiln, thus reducing the distances for transport.

In a tunnel kiln according to the present invention with two kiln channels in parallel relationship, which are operated in opposite directions, according to still another preferred embodiment of the invention in particular two means as described above may be provided which are arranged in mirror-inverted fashion and one after the other with respect to the longitudinal direction of the tunnel kiln, where in the one case the offtake means is provided in the one channel of the kiln and, in the other case, the offtake means is provided in the other channel of the kiln.

Thus a suction of the combustible gases and a recycling of the available heat produced during the combustion is achieved over the entire length of the firing sections of both channels of the kiln, as will subsequently be described in more detail in connection with the preferred embodiment of the invention.

A further gain of energy may be achieved by providing an additional fresh air supply means running along at least a partial section of the walls/ceiling of one or both channels of the kiln and which is connected to the channel of the kiln in the region of the preheating section thereof. In a similar manner as described above in connection with the fresh air supply line to the firing section the heat accumulated in the brickwork of the wall of the kiln is utilized for providing air for preheating the products without own heating apparatus/burners. For example, the fresh air supply means may be guided around the cooling section of one channel of the kiln and may be connected to the preheating section, adjacent to the cooling section, of the other channel of the kiln.

A preferred embodiment of the invention suggests to connect an offtake means from the preheating section of the one and/or other channel of the kiln to a chamber separated from the channels of the kiln, preferably to a channel, in which at least a heating means is arranged, preferably a burner. The substances containing only a small amount of combustible material which are introduced here may be burned, before they are discharged by an offtake means from the chamber/channel through a chimney to the outside.

The additional combustion chamber also serves to provide a post-combustion of the flue gases which circulate through the above-mentioned means in the firing section of the two channels of the kiln. Obviously the above-indicated offtake, combustion, and recycling of the flue gases in the firing section cannot be performed in a cycle forever, but a relief means has to be provided for taking off a partial gas flow from the kiln channel(s). In a preferred embodiment of the invention a relief line is provided connecting that section of the kiln where the means according to the present invention, as mentioned above, is arranged, to this additional (post-combustion) chamber in the region of the preheating section for another post-combustion of the gases which are thus purified and subsequently discharged, via the chimney, to the outside.

For providing a more uniform kiln atmosphere it is finally suggested to provide circulation fans, preferably in the ceiling region of the channels of the kiln.

Although the present invention has above been described in connection with a tunnel kiln having two kiln channels arranged in mutually parallel relationship and operated in opposite directions, the means with offtake means/combustion chamber/feedback means according to the present invention may also be provided with a conventional endcharge-and-discharge kiln having one channel, where, if need be, several such arrangements have to be arranged in series in the longitudinal direction of the kiln for achieving an optimum, whereas—according to the present invention—the burned flue gases may be supplied to the channels of the kiln arranged side by side over short distances.

Further features of the invention are given by the remaining claims and the description.

Figure 2:
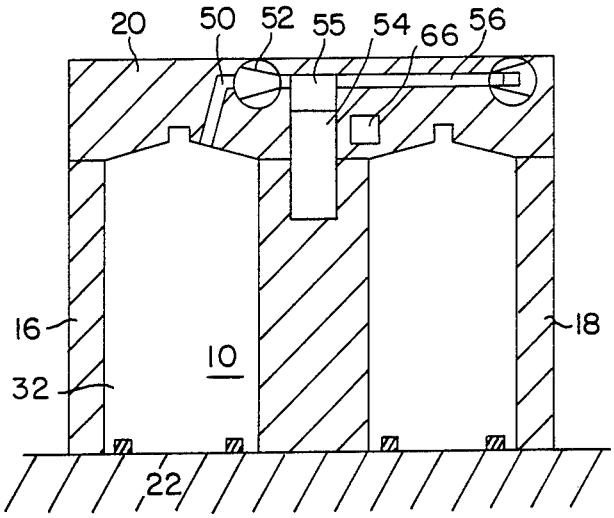
Figure 3:
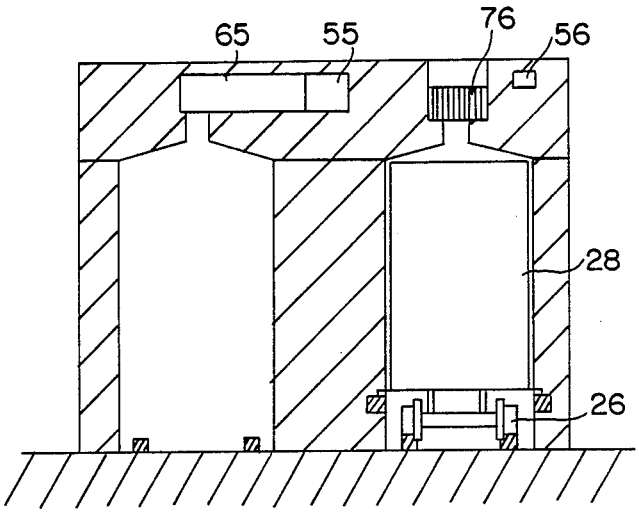

The invention will subsequently be explained in connection with a preferred embodiment. The drawing shows in:

FIG. 1 a top view of a tunnel kiln according to the present invention having two mutually parallel kiln channels;

FIG. 2 a cross section taken along line A–B;

FIG. 3 a cross section taken along line C–D; and

Figure 4:
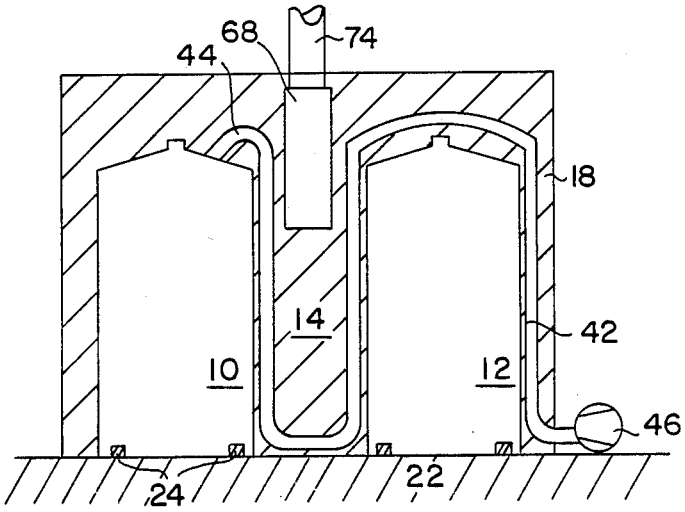

FIG. 4 a cross section taken along line E–F.

The tunnel kiln according to the invention as shown in FIG. 1 has two kiln channels 10, 12 arranged in mutually parallel relationship which are divided by a wall 14 extending between the channels. As particularly shown in FIGS. 2 to 4, the kiln channels 10, 12 are further closed by side wall 16, 18 and a common ceiling 20 as well as common bottom 22.

FIG. 1 shows outside rail pairs 24 where, for example, tunnel kiln carts 26 are guided for transport through the kiln channels 10, 12. Whereas the direction of transport of carts 26 and, therefore, the products 28 to be fired is from left to right, in the direction of arrow A for the above kiln channel 10 in the top view of FIG. 1, the direction of transport for carts 26 through kiln channel 12 is in the opposite direction (arrow B). Correspondingly, kiln channel 10 in FIG. 1 is divided, from left to right, into a preheating section 30, a firing section 32 adjacent thereto, and two annexed cooling section parts 34, 35, whereas kiln channel 12 shows a similar arrangement in the opposite direction (preheating section 36, firing section 38, cooling section parts 40, 41).

As can be seen in particular from the sectional view of FIG. 4, a fresh air supply line 42 runs from the outside through side wall 18 over ceiling region 20 and wall 14 around kiln channel 12, and line 42, after a short section somewhat above bottom 22, runs upwards again in the region of wall 14, and is connected, after a bending part 44, to the ceiling region 20 of kiln channel 10. Outside, at the entrance to wall 18, a fan 46 is provided for transporting fresh air through line 42 into kiln channel 10, whereby the air heats up during its passage inside the walls/ceiling.

This arrangement is located approximately in the middle (with respect to the direction of transport) of preheating section 30 and cooling section 41, respectively. Sections 30, 41 are, for the rest, separated from the annexed firing section 32 and preceding cooling section 40, respectively, by locks 48 known in the art. Locks 48 (shown only schematically in FIG. 1 as arrows) may consist of slide gates movable into kiln channel 10, 12 which render possible a narrowing of the cross section of kiln channels 10, 12 corresponding to the sizes of the respective kiln cart 26 which is led through. Such locks 48 are also arranged at the entrance and exit sides as well as between firing section 32 and cooling sections 34 and both cooling sections 34, 35. The same applies to locks 48 in the region of kiln channel 12.

Sectional view A - B (FIG. 2) shows the form of the tunnel kiln according to the invention immediately after lock 48 between preheating section 30 and firing section 32 of kiln channel 10, and immediately before lock 48 between cooling section 40 and cooling section 41 of kiln channel 12, respectively.

An offtake line 50 having a fan (suction means) 52 extends from ceiling region 20 of firing section 32 of kiln channel 10 via a channel piece 52 arranged parallel to and inside kiln wall 14 to a firing chamber 54 which is, as can also be seen from FIG. 1, formed as an enlarged channel in the region of wall 14 between kiln channels 10, 12 in the region of the ceiling 20. From the mouth region of offtake line 50 the firing chamber 54 extends to the locks 48'.

In immediate proximity to the mouth of offtake line 50 into firing chamber 54 a fresh air supply line 56 is connected which, as can be seen in particular in figure 1, extends in the direction of wall 18 and subsequently, after a bend of 90°, parallel to kiln channels 10, 12 and leads to the outside, approximately in the region of line C - D, upwards out of ceiling 20.

From there fresh air can be taken in which is heated up during the passage along the (hot) ceiling of the kiln and is transported to combustion chamber 54 by means of a fan 60 disposed in the region of bend 58. Thus, oxygen is transported into combustion chamber 54. From the end of combustion chamber 54 (at 48'), in its extension, a supply line 55 is disposed which transports previously burned flue gases in the direction towards the opposite end of the kiln. This transport may again be supported by fans. In distant relationship to each other branch parts 62, 63, 64, 65 are provided extending, in the region of ceiling 20, from supply line 55 to kiln channel 10 (branch parts 63, 65) and to kiln channel 12 (branch parts 62, 64), respectively.

In this manner flue gas containing combustible components which has been sucked from kiln channel 10 via offtake line 50 is transported to combustion chamber 54, where a self-combustion, without burners, of the flue gases containing the combustible components takes place, whereas the hot gases which have thus been burned are subsequently recycled via line 55 and branch parts 62, 63, 64, 65 into firing sections 32, 38 and purified at the same time.

Hereby it is particularly advantageous to arrange the offtake means at the start of the firing section (as viewed in the direction of transport) of a kiln channel, because in particular in this region high amounts of pyrolysable substances are emitted during the firing of carbonaceous green bodies (for example electrodes impregnated with pitch), and because here the portion of combustible substances is particularly high, that is—as has been found during the development of the invention—so high, that a combustion without any burner support is feasible. Only during "startup" of the kiln the flue gas is initially ignited by a start (support) burner (not shown), whereas for the later combustion it is only necessary to provide an adequate amount of oxygen via line 56. The oxygen supply is preferably automatically controlled, depending on the atmosphere and the desired temperature, for example by means of flow control valves (not shown).

In the region of branch part 62 in this embodiment a relief line 66 is provided which serves to divert, at the end of firing section 38 of the kiln channel 12, flue gases from the kiln channel and which, after a distance essentially parallel to firing chamber 54, is connected to a post-combustion chamber 68 which is, for the most part, arranged in alignment in front of combustion chamber 54 (as viewed in the direction of transport of kiln channel 10). Post-combustion chamber 68 runs as a channel until shortly before the face of wall 14 in the region of the entrance of kiln channel 10 and the exit of kiln channel 12, respectively. At the diagonally opposite end with respect to the entrance of relief line 66 a line 70 is connected the other end of which is connected to the area of the ceiling 20 of kiln channel 10.

A fan arranged along line 70 serves to supply the drawnoff air having been taken from preheating section 30 to post-combustion chamber 68, where a heating means preferably a burner (not shown), is arranged for a postcombustion of the waste gas. The flue gas thus purified may be carried away to the outside via a chimney 74 protruding upwards from post-combustion chamber 68 (FIG. 4).

Along kiln channels 10, 12 furthermore circulating fans 76 are arranged in the ceiling section and mutually spaced apart which serve to make the flue gases in the kiln channels 10, 12 more uniform. This arrangement is shown particularly in FIG. 3. This figure also shows again supply line 55 along which the purified flue gases are led after their combustion, and branch part 65, over which the purified flue gas reaches a portion of firing section 32 of kiln channel 10.

FIG. 1 shows that the above-indicated arrangement is repeated in mirror-inverted fashion in the right half of the tunnel kiln according to the invention shown in FIG. 1, that is that here the post-combustion chamber 78 extends in front of firing chamber 80 and supply line 81 ending in a distance to supply line 55, respectively. With the means according to the invention it is not necessary to guide the burned flue gases along the entire firing section section for supplying them via respective branches to the firing chamber, but rather a bipartition is performed with the embodiment as shown, in order to shorten the transport distances of the flue gas and to render the means more efficient as a whole.

Another partition over the length of the kiln is also possible.

With the kiln according to the present invention a selfsupporting control of the firing process independent of burners fueled by oil, gas, or coal is possible. Except for the minimal energies for the initial ignition the kiln is heated solely by the energy gained from the flue gases.

What is claimed is:

1. A tunnel kiln for heat treating green bodies (28) containing pyrolysable substances, comprizing two kiln channels (10, 12) arranged in mutually parallel relationship and operated in opposite directions, each kiln channel having at least one heating section (30, 36), firing section (32, 38), and cooling section (34, 35; 40, 41), characterized by the following features:

(a) from at least one of said kiln channels (10, 12) extends an offtake means (50) for the flue gas to a chamber (54) separated from said kiln channels (10, 12), (b) said chamber (54) is designed as a combustion chamber for the flue gases without burner support, (c) from said combustion chamber (54) extends supply means (55) for the burned flue gases, (d) said supply means (55) is connected to said one and/or said other kiln channel (10, 12) in distant relationship with respect to said offtake means (50), a fresh air supply line (56) is connected to said combustion chamber (54), said fresh air supply line (56) is connected, in the admission region of the flue gases to be burned, to said combustion chamber (54), said fresh air supply line (56) extends along at least a partial section of the walls/ceiling (18, 20, 14) of one of said kiln channels (12), preferably in the region of said firing section (38), and that at least one ventilating means (60) is provided along the way, a support burner is arranged in said combustion chamber (54) for initially igniting the admitted flue gases, in the region of said offtake means (50) and/or said supply means (55) at least one fan and/or at least one suction means (52) are provided, said offtake and/or supply means (50, 55) are formed as channels, said offtake means (50) and/or said supply means (55) extend from said ceiling region (20) of one of said kiln channels (10) and run into it, respectively, said supply means (55) runs into (63, 65; 62, 64) said kiln channel (10, 12) in short distance with respect to said offtake means (50), said offtake means (50) and/or said supply means (55) extend from said respective firing section (32, 38) of said two kiln channels (10, 12), said chamber (54) is arranged in parallel relationship with respect to said kiln channels (10, 12) and between said kiln channels, at least two mutually separate combustion chambers (54, 80) are arranged with their respective offtake and supply means (50, 55, 81) arranged one after the other and in mirror-inverted fashion, a further fresh air supply means (42) extending along at least a partial section of the wall/ceiling (18, 20, 14) of said kiln channel or both kiln channels (12, 10) runs into said kiln channel (10) in the region of the preheating section (30) of said kiln channel (10), said fresh air supply means (42) is guided around said cooling section (41) of said kiln channel (12) and runs into said preheating section (30), which is annexed to said cooling section (41), of said other kiln channel (10), from said preheating section (30) of one and/or said other kiln channel (10) an offtake means (70) runs into a chamber (68), preferably a channel, which is separated from said kiln channels (10, 12), where said chamber (68) at least one heating means, preferably a burner, is disposed and where, in a distance with respect to the mouth of said offtake means (70), a chimney (74) extends from said chamber/channel (68), in the region of said offtake means (70) at least one fan (72) and/or at least one suction means are provided, a further offtake line (66) from said firing section (38) of said kiln channel (12) runs into said chamber (68), along the path of the kiln channel at least one circulating fan (76) is arranged, preferably in the region of said ceiling (20), said individual kiln sections (30, 32, 34, 35; 36, 38, 40, 41) are mutually separated by locks (48) which are movable into said kiln channel (10, 12), and the design is mirror-inverted with respect to a plane in the middle of the longitudinal extension.

2. A tunnel kiln for heat treating green bodies (28) containing pyrolysable substances, comprizing two kiln channels (10,12) arranged in mutually parallel relationship and operated in opposite directions, each kiln channel having at least one heating section (30, 36), firing section (32, 38), and cooling section (34, 35; 40, 41), wherein (a) from at least one of said kiln channels (10, 12) extends an offtake means (50) for the flue gas to a chamber (54) separated from said kiln channels (10, 12), (b) said chamber (54) is designed as a combustion chamber for the flue gases without burner support and a fresh air supply line (56) is connected to said combustion chamber (54), (c) from said combustion chamber (54) extends supply means (55) for the burned flue gases, and (d) said supply means (55) is connected to said one and/or said other kiln channel (10, 12) in distant relationship with respect to said offtake means (50).

3. A tunnel kiln as claimed in claim 2, characterized in that said fresh air supply line (56) is connected, in the admission region of the flue gases to be burned, to said combustion chamber (54).

4. A tunnel kiln as claimed in claim 2, characterized in that said fresh air supply line (56) extends along at least a partial section of the walls/ceiling (18, 20, 14) of one of said kiln channels (12), preferably in the region of said firing section (38), and that at least one ventilating means (60) is provided along the way.

5. A tunnel kiln as claimed in claim 2, characterized in that a support burner is arranged in said combustion chamber (54) for initially igniting the admitted flue gases.

6. A tunnel kiln as claimed in claim 2, characterized in that in the region of said offtake means (50) and/or said supply means (55) at least one fan and/or at least one suction means (52) are provided.

7. A tunnel kiln as claimed in claim 2, characterized in that said offtake and/or said supply means (50, 55) are formed as channels.

8. A tunnel kiln as claimed in claim 2, characterized in that said offtake means (50) and/or said supply means (55) extend from said ceiling region (20) of one of said kiln channels (10) and run into it, respectively.

9. A tunnel kiln as claimed in claim 2, characterized in that said supply means (55) runs into (63, 65; 62, 64) said kiln channel (10, 12) in short distance with respect to said offtake means (50).

10. A tunnel kiln as claimed in claim 2, characterized in that said offtake means (50) and/or said supply means (55) extend from said respective firing section (32, 38) of said two kiln channels (10, 12).

11. A tunnel kiln as claimed in claim 2, characterized in that said chamber (54) is arranged in parallel relationship with respect to said kiln channels (10, 12) and between said kiln channels.

12. A tunnel kiln as claimed in claim 2, characterized in that at least two mutually separate combustion chambers (54, 80) are arranged with their respective offtake and supply means (50, 55, 81) arranged one after the other and in mirror-inverted fashion.

13. A tunnel kiln as claimed in claim 2, characterized in that a further fresh air supply means (42) extending along at least a partial section of the wall/ceiling (18, 20, 14) of said kiln channel or both kiln channels (12, 10) runs into said kiln channel (10) in the region of the preheating section (30) of said kiln channel (10).

14. A tunnel kiln as claimed in claim 13, characterized in that said fresh air supply means (42) is guided around said cooling section (41) of said kiln channel (12) and runs into said preheating section (30), which is annexed to said cooling section (41), of said other kiln channel (10).

15. A tunnel kiln as claimed in claim 2, characterized in that from said preheating section (30) of one and/or said other kiln channel (10) an offtake means (70) runs into a chamber (58), preferably a channel, which is separated from said kiln channels (10, 12), where in said chamber (68) at least one heating means, preferably a burner, is disposed and where, in a distance with respect to the mouth of said offtake means (70), a chimney (74) extends from said chamber/channel (68).

16. A tunnel kiln as claimed in claim 15, characterized in that in the region of said offtake means (70) at least one fan (72) and/or at least one suction means are provided.

17. A tunnel kiln as claimed in claim 2, characterized in that a further offtake line (66) from said firing section (38) of said kiln channel (12) runs into said chamber (68).

18. A tunnel kiln as claimed in claim 2, characterized in that along the path of the kiln channel at least one circulating fan (76) is arranged, preferably in the region of said ceiling (20).

19. A tunnel kiln as claimed in claim 2, characterized in that said individual kiln sections (30, 32, 34, 35; 36, 38, 40, 41) are mutually separated by locks (48) which ar movable into said kiln channel (10, 12).

20. A tunnel kiln as claimed in claim 2, characterized in that the design is mirror-inverted with respect to a plane in the middle of the longitudinal extension.

21. A tunnel kiln for heat treating green bodies containing pyrolysable substances, comprising two kiln channels arranged in mutually parallel relationship and operated in opposite directions, each kiln channel having a heating section, a firing section, and a cooling section, a combustion chamber separated from the kiln channels for burning flue gases without burner support, offtake means for transporting flue gases from at least one of the kiln channels to the combustion chamber, a fresh air supply line connected to the combustion chamber for supplying fresh air to the combustion chamber, and supply means for supplying burned flue gases from the combustion chamber to at least one kiln channel.

* * * * *